United States Patent [19]

Kozlin

[11] Patent Number: 4,589,824

[45] Date of Patent: May 20, 1986

[54] ROTOR BLADE HAVING A TIP CAP END CLOSURE

[75] Inventor: Joseph R. Kozlin, Jupiter, Fla.

[73] Assignee: United Technologies Corporation, Hartford, Conn.

[21] Appl. No.: 64,604

[22] Filed: Aug. 7, 1979

Related U.S. Application Data

[63] Continuation of Ser. No. 844,257, Oct. 21, 1977, abandoned.

[51] Int. Cl.[4] ..... F01D 5/18

[52] U.S. Cl. ..... 416/97 R; 416/232; 29/156.8 H; 29/156.8 B

[58] Field of Search ..... 29/156.8 H, 156.8 B; 416/96 R, 96 A, 97 R, 97 A, 232; 220/345, 346

[56] References Cited

U.S. PATENT DOCUMENTS

| | | | |
|---|---|---|---|
| 2,992,726 | 7/1971 | Simens | 220/345 |
| 3,201,064 | 8/1965 | Dagle et al. | 220/345 |
| 3,527,373 | 9/1970 | Giraudet et al. | 220/345 |
| 3,574,482 | 4/1971 | Savage et al. | 416/232 |
| 3,867,068 | 2/1975 | Corsmeier et al. | 416/97 R |
| 3,989,412 | 11/1976 | Mukherjee | 416/97 R |
| 4,010,531 | 3/1977 | Anderson et al. | 416/97 R |
| 4,048,682 | 9/1977 | Smith | 220/345 |
| 4,073,599 | 2/1978 | Allen et al. | 416/97 R |

*Primary Examiner*—Daniel C. Crane

*Attorney, Agent, or Firm*—Gene D. Fleischhauer

[57] ABSTRACT

An airfoil structure for use in an axial flow turbomachine is disclosed. Various construction details which improve the durability, integrity and the cooling effectiveness of the structure are shown and a method for fabricating the structure is developed. The tip of the structure is closed by a tip cap, and in one embodiment, a ductile material is deposited between the tip of the structure and the tip cap to prevent the leakage of cooling medium.

19 Claims, 6 Drawing Figures

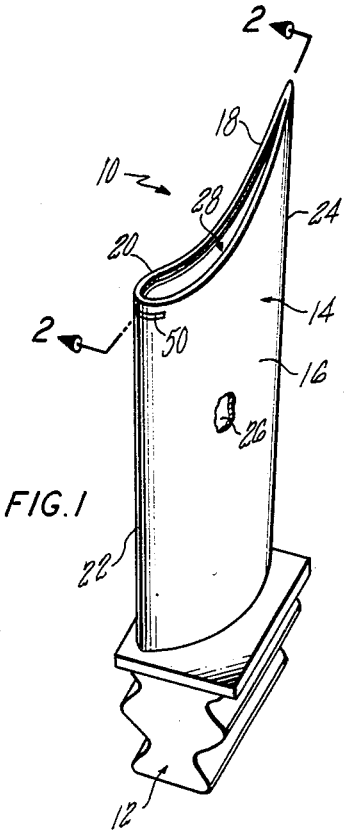
FIG. 1
FIG. 2
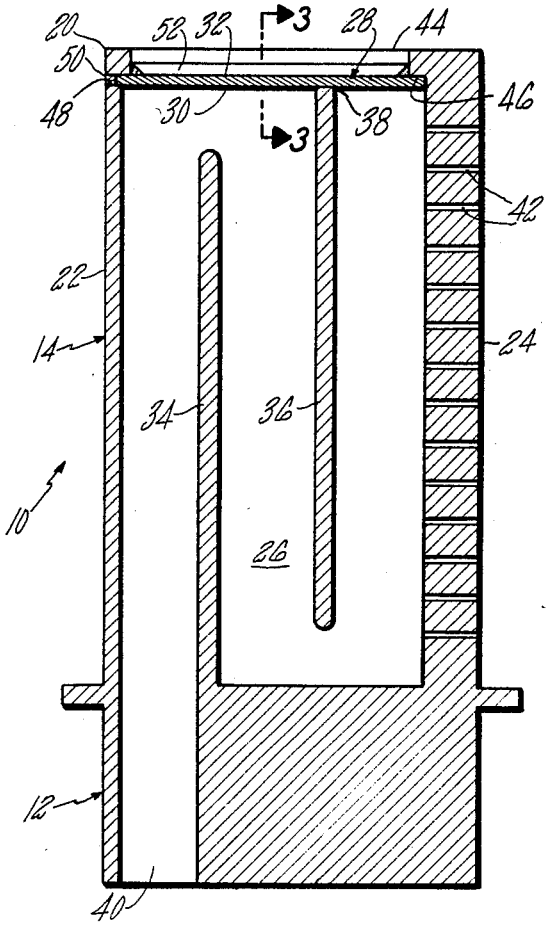
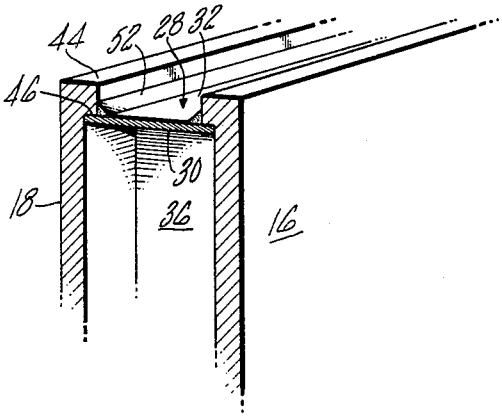
FIG. 3
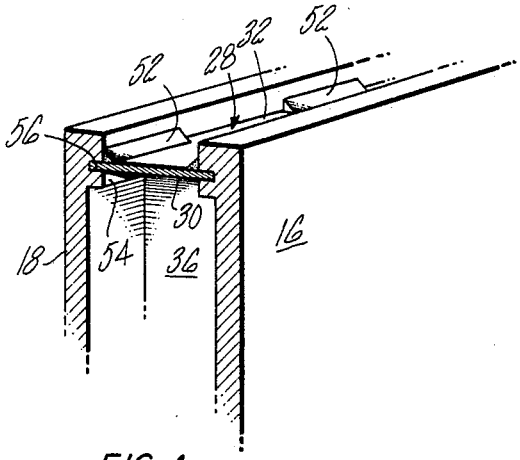
FIG. 4

FIG. 5
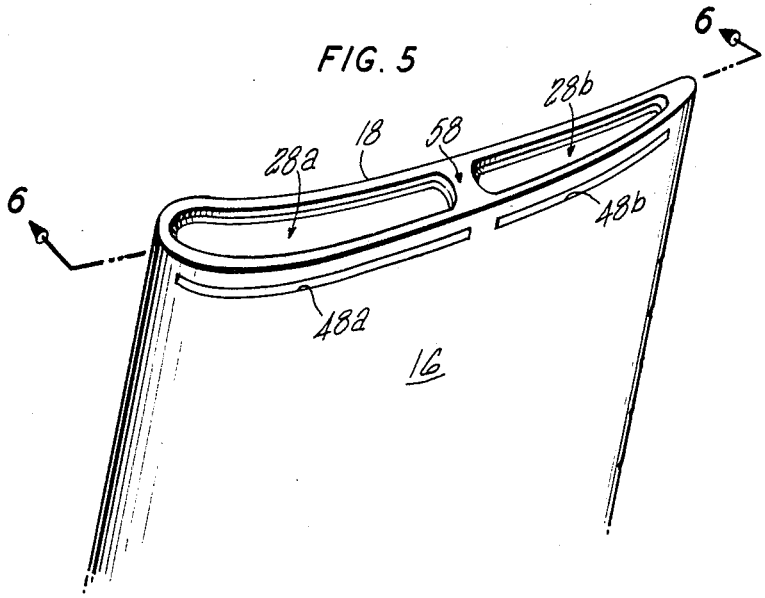
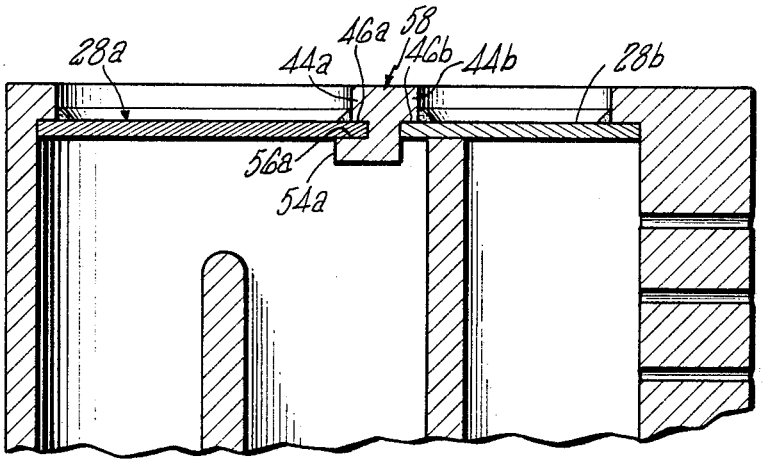
FIG. 6

ROTOR BLADE HAVING A TIP CAP END CLOSURE

This is a continuation of application Ser. No. 844,257, filed Oct. 21, 1977, now abandoned.

BACKGROUND OF THE INVENTION

This invention relates to high temperature airfoils for axial flow rotary machines. Such airfoils conventionally have internal cooling chambers through which a cooling medium flows during operation of the machine. One effecitve technique for fabricating airfoils with internal chambers is described in U.S. Pat. No. 3,029,485 to McCormick entitled "Method of Making Hollow Castings". In McCormick, a core mold extending in the spanwise direction through the airfoil is supported during the casting process, outside of the airfoil at both the root and tip ends. Supporting the core mold from both ends decreases the likelihood that the core will shift from physical handling or from thermal shocks during the casting procedure. Collaterally, the opening left in the airfoil tip when the core mold is removed facilitates inspection of the interior for casting flaws. Having fabricated the airfoil tip with an opening, the opening must be closed to prevent the leakage of cooling air from the internal chamber during operation. Tip caps are commonly used to close the opening.

One tip cap structure is shown in U.S. Pat. No. 2,779,565 to Bruckmann entitled "Air Cooling of Turbine Blades." In Bruckmann, the tip cap is welded to the tip of the airfoil. In modern, high temperature engines, weld materials having sufficient yield strength often have inherently low fatigue strength. This low fatigue strength may precipitate low cycle fatigue failure of the weld and may result in the leakage of cooling air from the internal chamber.

U.S. Pat. No. 3,982,851 to Andersen et al entitled "Tip Cap Apparatus", U.S. Pat. No. 4,010,531 to Andersen et al entitled "Tip Cap Apparatus and Method of Installation" and U.S. Pat. No. 4,073,599 to Allen et al. entitled "Hollow Turbine Blade Tip Closure" are of interest for their contemporaneous showings of structures alternative to those of the present invention. These structures locally support the tip cap but do not provide continuous engagement between the tip cap and the airfoil structure. These structures rely on the deposition of brazed material to prevent the leakage of air from the interior of the airfoil. High speed inertial forces acting on the tip cap in regions without continuous engagement cause the tip cap to pull away from the adjacent structure. The cooling medium in the internal chamber leaks between the cap and the adjacent structure, and decreased cooling effectiveness results.

The need to produce energy efficient machines has grown in recent years because of increased fuel costs and limited fuel supplies. As a result, research efforts are being directed toward improving the cooling effectiveness and structural integrity of airfoil structures.

SUMMARY OF THE INVENTION

A primary aim of the present invention is to improve the integrity and durability of airfoil cooling structures in axial flow rotary machines. A decrease in the loss of cooling medium between an airfoil tip of a rotor blade and a corresponding tip cap is sought, and one specific goal is to provide an effective seal between each airfoil tip and the corresponding tip cap.

According to the present invention the airfoil tip of a hollow rotor blade is provided with a continuous lip which engages the outer perimeter of a tip cap both to restrain the tip cap during the rotation of the blade and to seal the hollow portion of the rotor blade.

In accordance with the present invention, the airfoil structure is fabricated by: forming a continuous seal lip at the tip region of a hollow airfoil section; forming a passageway in the side of the airfoil section, inserting a tip cap through the passageway to engage the continuous seal lip; and, depositing a ductile material in the passageway. In one embodiment, the fabrication includes the additional step of depositing a ductile material between the continuous seal lip and the tip cap.

A primary feature of the present invention is the airfoil structure housing a separately formed tip cap. A continuous seal lip at the tip of the airfoil structure engages the perimeter of the tip cap. Access to the continuous seal lip for installation of the tip cap is provided through a passageway in the side of the airfoil structure. In one embodiment, a ductile material connects the tip cap and the continuous seal lip.

A principal advantage of the present invention is the low susceptibility of the structure to early fatigue failure. Cooling effectiveness is improved through the elimination of leak paths between each airfoil tip and its contiguous tip cap. In the embodiment employing a seal material, the increased ductility of the seal material reduces cracking of the seal material caused by thermal growth differences between the continuous seal lip and the tip cap.

BRIEF DESCRIPTION OF THE DRAWINGS

FIG. 1 is a perspective view of a rotor blade;

FIG. 2 is a sectional view taken along the line 2—2 as shown in FIG. 1;

FIG. 3 is a perspective view of a fragment of the rotor blade;

FIG. 4 is a perspective sectional view corresponding to the FIG. 3 view and shows an alternate embodiment;

FIG. 5 is a perspective view of a rotor blade showing an alternate embodiment of the invention; and FIG. 6 is a sectional view taken along line 6—6 as shown in FIG. 5.

DESCRIPTION OF THE PREFERRED EMBODIMENT

A rotor blade for an axial flow gas turbine engine is illustrated in the FIG. 1 perspective view. The rotor blade 10 has a root section 12 and an airfoil section 14. The airfoil section is formed of a suction side wall 16 and a pressure side wall 18 both extending in a spanwise direction from the root section to a tip region 20. The suction and pressure side walls are chordwisely continuous in the tip region and are joined at a leading edge region 22 and a trailing edge region 24 to form an internal cavity 26. A one piece tip cap 28 closes the internal cavity at the tip region.

As is illustrated in FIG. 2, the tip cap 28 has an inner surface 30 and an outer surface 32. A first baffle 34 spans the internal cavity 26 and extends from the root section 12 toward the tip cap 28. A second baffle 36 spans the internal cavity and extends from the tip cap toward the root section. The end 38 of the second baffle abuts the inner surface of the tip cap. Extending through the root section is an aperture 40 for supplying cooling air to the internal cavity. Extending through the trailing edge are a plurality of holes 42 for discharging cooling air from the internal cavity. Extending inwardly from the walls of the airfoil section 14 in the tip region 20 is an uninterrupted support such as a continuous seal lip 44. The seal lip has a continuous seal surface such as an inwardly facing inner surface 46 which opposes the perimeter of the outwardly facing outer surface of the tip cap. An aperture such as passageway 48 in the airfoil wall beneath the continuous lip and spanwisely inward of the chordwisely continuous side walls provides access to the internal cavity for insertion of the tip cap. A plug 50 seals the passageway 48 and may be made, for example, from a ductile material. The plug has an outer surface flushly contoured to match the geometry of the side wall which the plug engages.

In at least one embodiment, such as that illustrated by FIG. 3, a ductile material 52 joins the tip cap 28 to the uninterrupted lip 44. The ductile material may be deposited continuously about the perimeter of the tip cap or at discrete locations as shown in FIG. 4.

In at least one embodiment, such as that illustrated by FIG. 4, a shelf 54 having an outwardly facing outer surface 56 supports the tip cap 28 with the surface 56 opposing the perimeter of the inner surface 30 of the tip cap.

The tip cap 28 may be formed as a single piece as illustrated in FIG. 1. In the other embodiments, however, it is advantageous to form the tip cap of two or more one piece sections. FIG. 5 illustrates a two section embodiment of the tip cap comprising a first section **28*a* and a second section 28*b*. Extending between the suction side wall 16 and the pressure side wall 18 is a support web 58. A first aperture such as first passageway 48*a* is provided for insertion of the first tip cap section and a second aperture such as second passageway 48*b*** is provided for insertion of the second tip cap section.

As is illustrated in FIG. 6, the support web 58 has: a first web lip **44*a* which has an inner surface 46*a* opposing the first section 28*a* of the tip cap; a second web lip 44*b* which has an inner surface 46*b* opposing the second section 28*b*. The inner surface 46*a* and the inner surface 46 cooperate to form a first continuous seal surface. The inner surface 46*b* and the inner surface 46 cooperate to form a second continuous seal surface. In at least one embodiment, the support web has a first web shelf 54*a* which includes an outer surface 56*a*** to support the first section of the tip cap.

During operation of the rotor blade 10, cooling air is flowed to the internal cavity 26 through the aperture 40 in the root section 12. The cooling air is subsequently discharged from the internal cavity through the holes 42 in the trailing edge region 24. The tip cap 28 closes the end of the internal cavity and causes the cooling air to be directed between baffle 34 and baffle 36 in a sinuous path.

The tip cap 28 is restrained against: outward spanwise movement by engagement with the continuous seal lip 44; inward spanwise movement by alternate embodiments such as the shelf 54; and chordwise movement by the ductile material 52, wall 18, and wall 20. As the blade 10 rotates, centripetal forces acting through the continuous seal lip 44 engage the tip cap and restrain the tip cap against outward spanwise movement. Ductile material forming the plug 50 in the passageway 48 and ductile material 52 disposed between the airfoil tip and the tip cap restrain the tip cap against chordwise movement. The bottom of passageway 48 in the airfoil wall and the end 38 of the second baffle 36 restrain the tip cap against inward spanwise movement of the tip cap.

In an alternate embodiment shown in FIG. 4, shelf 54 has an outwardly facing surface 56 to restrain the tip cap against inward spanwise movement.

A distinct and particular advantage of this invention is the improvement in the cooling effectiveness of the airfoil structure. The cooling effectiveness is improved by the formation of a continuous mechanical seal, at the perimeter of the tip cap 28, decreasing the loss of cooling air. An effective, uninterrupted seal is created by the seal lip 44 pressing tightly against the tip cap as rotational forces are transmitted from the seal lip to the tip cap. The tip cap is preferably thin enough to flexibly conform to the seal lip 44. A plug 50 of ductile material seals the passageway 48. In at least one embodiment, a ductile material 52 is disposed between airfoil section walls 16 and 18 and tip cap outer surface 32 in a continuous strip to increase the effectiveness of the seal. Alternatively, the ductile material is disposed in several discrete strips contacting both the continuous seal lip and the outer surface 32 of the tip cap along a portion of the wall surface juncture. The plug, the continuous strip and the discrete strips have an acceptable low cycle fatigue strength and satisfactory structural integrity. The ductility of the material accommodates differences in thermal growth between the airfoil tip and the tip cap.

The airfoil and root sections of the blade are cast from a material suitable for use within the high temperature environment of a gas turbine engine. The continuous seal lip 44 in the tip region 20 of the blade is integrally formed in the casting process. The passageway 48 is formed beneath the seal lip during the casting process or is subsequently machined into the airfoil wall. The tip cap 28 is ideally fabricated of a sheet metal material and has sufficient ductility so as to conform to the seal lip when acted upon by rotational forces. A cap thickness on the order of 0.050 of an inch for a cap width of one-half inch at the cap's widest portion and 0.025 of an inch for a cap width of one-quarter inch has been found to be satisfactory. The tip cap is inserted through the passageway and is held adjacent to the seal lip by the end 38 of the inwardly extending baffle 36. In at least one embodiment the cap is held adjacent to the seal lip by a shelf 54 cast into the interior of the airfoil walls. A plug 50 is inserted in passageway 48 for sealing and may be made, for example, from a ductile braze material such as AMS (SAE Aerospace Material Specifications) 4775 or AMS 4776 using a nickel alloy brazing process such as AMS 2675D. In an alternate embodiment, the tip cap is formed of two or more sections and is installed in a correspondingly similar manner. Passageways are formed for each tip cap section and the passageways are sealed with plugs, for example, made of a ductile material. In another alternate embodiment, ductile material 52 is deposited between the tip cap and the continuous seal lip projecting from the suction side wall 16 and the pressure side wall 18. The ductile material is deposited in a continuous strip or is deposited in discrete strips and may be a braze material such as AMS 4775 or 4776 braze, modified for wide gap applications by the addition of 80% Ni, 20% Cr powder. The ductility of the material 52 is sufficient to allow for accommodation of the thermal growth differences between the tip cap and the airfoil walls.

Those skilled in the art will recognize that more than two tip caps may be used. In addition, they will recognize that other means of inward restraint of the tip cap may be employed to prevent the tip cap from moving radially inward when the airfoil is not rotating. They will also recognize that the plug for the passageway may be fabricated from materials other than the ductile material used between the continuous seal lip and the tip cap.

Although the invention has been shown and described with respect to its preferred embodiments, those skilled in the art will understand that various changes and omissions in the form and detail of the invention may be made without departing from the spirit and the scope of the invention.

Having thus described typical embodiments of my invention, that which I claim as new and desire to secure by Letters Patent of the United States is:

1. For an axial flow rotary machine, a rotor blade structure which comprises:

an airfoil section having a pressure side wall and a suction side wall which form an internal cavity therebetween wherein said airfoil section has a tip region including a chordwisely continuous suction side wall, a chordwisely continuous pressure side wall, an uninterrupted lip extending inwardly from the chordwisely continuous seal surface, and an aperture in at least one of said walls of the airfoil section spanwisely inward of the chordwisely continuous side walls which has a continuous perimeter to provide access to the continuous seal surface of the uninterrupted lip during manufacture of the blade;

a one piece tip cap which has an outer surface oriented in opposing relationship to the continuous seal surface of the uninterrupted lip such that the entire perimeter of the outer surface of the tip cap is engageable by the continuous seal surface of the uninterrupted lip in response to rotational forces resulting from operation of the axial flow rotary machine; and, a plug disposed in said aperture which engages the perimeter of the aperture for sealing of the aperture and chordwise retention of the tip cap, the plug having an outer surface flushly contoured to match the geometry of the side wall which the plug engages.

2. The invention according to claim 1 wherein the airfoil section further has a shelf which extends inwardly from the walls of the airfoil section and is parallel to and spaced inwardly from the continuous seal surface of the uninterrupted lip.

3. The invention according to claim 1 which further has a ductile material disposed between the uninterrupted lip and the tip cap for chordwise retention of the tip cap.

4. The invention according to claim 3 wherein the ductile material is deposited between the uninterrupted lip and the tip cap in a continuous strip.

5. The invention according to claim 4 wherein the airfoil section further has a shelf which extends inwardly from the walls thereof wherein said shelf is parallel to and is spaced inwardly from the continuous seal surface of the uninterrupted lip.

6. The invention according to claim 4 wherein said tip cap has an inner surface, and wherein the airfoil section further has a baffle extending between the pressure side wall and the suction side wall thereof, the baffle having an end opposing the inner surface of said tip cap to support the cap.

7. The invention according to claim 6 wherein said tip cap extends into said aperture.

8. The invention according to claim 1 wherein said tip cap has an inner surface, and wherein the airfoil section further has a baffle extending between the pressure side wall and the suction side wall thereof, the baffle having an end opposing the inner surface of said tip cap to support the tip cap.

9. The invention according to claim 8 wherein said tip cap extends into said aperture.

10. For an axial flow rotary machine, a rotor blade structure which comprises:

an airfoil section having a pressure side wall and a suction side wall which form an internal cavity therebetween wherein said airfoil has a tip region including a chordwisely continuous suction side wall, a chordwisely continuous pressure side wall, a lip extending inwardly from the chordwisely continuous side walls of the tip region, a support web extending between the continuous suction side wall and the continuous pressure side wall at the tip region, and including a first web lip, and a second web lip, a first continuous seal surface facing inwardly on the first web lip and on the lip extending from the side walls, a second continuous seal surface facing inwardly on the second web lip and on the lip extending from the side walls, a first aperture in at least one of said walls of the airfoil section spanwisely inward of the chordwisely continuous side walls which has a continuous perimeter to provide access to the first continuous seal surface during manufacture of the blade, and a second aperture in at least one of said walls of the airfoil section spanwisely inward of the chordwisely continuous side walls which has a continuous perimeter to provide access to the second continuous seal surface during manufacture of the blade;

a tip cap having a one piece, first section having an outer surface oriented in opposing relationship to the first continuous seal surface such that the entire perimeter of the outer surface of the first section of the tip cap is engageable by the first continuous seal surface in response to rotational forces, and a one piece, second section having an outer surface oriented in opposing relationship to the second continuous seal surface such that the entire perimeter of the outer surface of the second section of the tip cap is engageable by the second continuous seal surface in response to rotational forces;

a plug disposed in said first aperture which engages the perimeter for sealing of the aperture and chordwise retention of the first section of the tip cap, the plug having an outer surface flushly contoured to match the geometry of the side wall which the plug engages; and a plug disposed in said second aperture which engages the perimeter for sealing of the aperture and chordwise retention of the second section of the tip cap, the plug having an outer surface flushly contoured to match the geometry of the side wall which the plug engages.

11. The invention according to claim 10 wherein said second section of the tip cap has an inner surface, and wherein the airfoil section further has a baffle extending between the pressure side wall and the suction side wall thereof, the baffle having an end opposing the inner surface of said tip cap to support the tip cap.

12. The invention according to claim 10 wherein the airfoil section further has a first web shelf which extends inwardly from the walls thereof wherein said shelf is parallel to and is spaced inwardly from the first continuous seal surface.

13. The invention according to claim 10 wherein said first section of the tip cap extends into said first aperture.

14. The invention according to claim 10 which further has a ductile material disposed between the lip extending inwardly from the side walls and the tip cap for chordwise retention of the tip cap.

15. The invention according to claim 14 wherein the ductile material is deposited in a continuous strip.

16. The invention according to claim 15 wherein said first section of the tip cap extends into said first aperture.

17. A method for installing a tip cap in sections in the tip region of a rotor blade having a suction side wall and a pressure side wall which form an internal cavity therebetween, comprising the steps of:

forming a chordwisely continuous suction side wall, and forming a chordwisely continuous pressure side wall;

forming a lip extending inwardly from the chordwisely continuous side walls of the blade of the tip region;

forming a support web extending between the continuous suction side wall and the continuous pressure side wall at the tip region having a first web lip, a second web lip;

forming a first continuous seal surface facing inwardly on the first web lip and on the lip extending from the side walls;

forming a second continuous seal surface facing inwardly on the second web lip and on the lip extending from the side walls;

forming a first aperture in at least one of said walls of the airfoil section spanwisely inward of the chordwisely continuous side walls which has a continuous perimeter to provide access to the first continuous seal surface during manufacture of the blade;

forming a second aperture in at least one of said walls of the airfoil section spanwisely inward of the chordwisely continuous side walls which has a continuous perimeter to provide access to the second continuous seal surface during manufacture of the blade;

inserting a one piece first section of the tip cap having an outer surface through the first aperture such that the entire perimeter of the outer surface of the tip cap engages the first continuous seal surface;

inserting a one piece second section of the tip cap having an outer surface through the second aperture such that the entire perimeter of the outer surface of the tip cap engages the second continuous seal surface;

disposing a plug in the first aperture such that the plug engages the entire perimeter of the aperture, the plug having an outer surface flushly contoured to match the geometry of the side wall which the plug engages; and disposing a plug in the second aperture such that the plug engages the entire perimeter of the aperture, the plug having an outer surface flushly contoured to match the geometry of the side wall which the plug engages.

18. The method as claimed in claim 17 comprising the additional step of:

depositing a ductile material between the lip extending from the side walls and the corresponding section of the tip cap.

19. The method as claimed in claim 18 wherein the step of depositing a ductile material between the side walls and the corresponding section of the tip cap includes the deposition of material in a continuous strip.

* * * * *